US005934264A

United States Patent [19]

Doornenbal

[11] Patent Number: 5,934,264

[45] Date of Patent: Aug. 10, 1999

[54] RECURVE BOW

[76] Inventor: Johannes Doornenbal, 16348 S. Van Allen Rd., Escalon, Calif. 95320

[21] Appl. No.: 08/425,900

[22] Filed: Apr. 21, 1995

Related U.S. Application Data

[63] Continuation-in-part of application No. 07/475,400, Feb. 5, 1990, Pat. No. 5,408,982.

[51] Int. Cl.[6] ..... F41B 5/10

[52] U.S. Cl. ..... 124/25.6; 124/23.1

[58] Field of Search ..... 124/23.1, 25.6, 124/86

[56] References Cited

U.S. PATENT DOCUMENTS

| | | | |
|---|---|---|---|
| 1,885,962 | 11/1932 | Swenson et al. | 124/23.1 X |
| 3,595,213 | 7/1971 | Storer | 124/17 |
| 3,744,473 | 7/1973 | Nishioka | 124/25.6 |
| 3,812,835 | 5/1974 | Smith | 124/25.6 |
| 3,990,425 | 11/1976 | Ketchum | 124/25.6 |
| 3,993,039 | 11/1976 | Groves et al. | 124/25.6 |
| 4,227,509 | 10/1980 | Jones | 124/25.6 |
| 4,287,867 | 9/1981 | Islas | 124/25.6 |
| 4,368,718 | 1/1983 | Simonds et al. | 124/25.6 |
| 4,438,753 | 3/1984 | Simonds | 124/25.6 |
| 4,478,203 | 10/1984 | Hayes | 124/25.6 |
| 4,561,413 | 12/1985 | Jennings | 124/25.6 |
| 4,593,674 | 6/1986 | Kudlacek | 124/25.6 |
| 4,646,708 | 3/1987 | Imes | 124/23.1 |
| 4,667,649 | 5/1987 | Humphrey | 124/25.6 |
| 4,724,820 | 2/1988 | Chattin | 124/25.6 |
| 4,781,168 | 11/1988 | Lester | 124/25.6 |
| 4,858,588 | 8/1989 | Bozek | 124/23.1 |
| 4,903,677 | 2/1990 | Colley et al. | 124/23.1 |

*Primary Examiner*—John A. Ricci
*Attorney, Agent, or Firm*—Bernhard Kreten

[57] ABSTRACT

An archery recurve bow having a handle and riser section which is substantially rigid, the risers supporting upper and lower limbs pivotally mounted thereto by means of guide plates which sandwich the limbs therebetween. Each limb has a tip which interconnects the limbs by means of a drawstring and tension cables are connected such that one cable extends from a butt end of one limb, remote from its tip, to the other limb between the pivot point at its tip. Conversely, the other cable is similarly connected from the butt end of the limb to its counterpart limb between the pivot point and the tip.

27 Claims, 3 Drawing Sheets

10
62
92
80
94
12
20
80
92
62

10
52
60
88

90
7
A
7
81
50
80
54
40
79
6
2A
64
6
22
26
28
12
16
20
51
8
2
6
56
18
38
30
79
40
64
80
50
58
81
A
60
52

C/L
10
60
40
30
22
12
24
20
14
5
40
5
60
C/L

RECURVE BOW

CROSS REFERENCE TO RELATED APPLICATIONS

This application is a continuation-in-part of application Ser. No. 07/475,400, filed Feb. 5, 1990, now U.S. Pat. No. 5,408,982.

FIELD OF THE INVENTION

The following invention relates generally to a recurve bow for use in archery. More specifically, the recurve bow according to the instant invention includes a handle, a pair of limbs pivotally connected to the handle by means of upper and lower guide plates, each of the limbs having tips interconnected by a drawstring and another portion of each limb interconnected by means of tensioning cables.

BACKGROUND OF THE INVENTION

Archery bows are tools which have existed since the earliest days of man. The earliest archery tools were used primarily as weapons of war and for hunting food. Typically, primitive bows consisted of a stick formed from resilient wood attached at terminal extremities by means of a string whereby the resilient stick formed a sort of "spring" which stored energy upon displacement of the bow from a neutral position to a cocked position. Upon release of the string, the stick would return to its original somewhat unstressed state and would propel an arrow carried on the string. This type of bow evolved into a "long" bow for greater power.

Recurve bows (i.e., where the limb tips arc away from the drawstring) have only been in existence for perhaps the last fifty years, and only upon the advent of lamination technology which allows a plurality of thin strips of material, such as wood, to be built up one upon the other so that more resiliency could be fabricated into the bow. As the quest for a bow having more power evolved, a tradeoff was experienced in the ability to control the bow at maximum draw. With long and recurve bows, the force increases as the degree of "draw" (i.e., the degree to which the bow has been cocked) increases.

Within the last thirty years compound bows, characterized by the utilization of cams or eccentric wheels, have been developed to create a mechanical advantage and change the traditional, linearly increasing force curve by the intercession of these mechanical elements. Compound bows, with their cams or eccentric wheels, have become complex and cumbersome instruments.

Recently, bows have been developed which incorporate the mechanical advantages associated with compound bows coupled with recurved limbs, but these bows are even more complex than the modern compound bows and, like the compound bow require cams or eccentric wheels to develop the desired draw characteristics popular with today's archers.

By and large, modem archery bows are used for hunting and target archery. There is a need for a bow which provides high performance, but which also is relatively simple in design, is easy and safe to use and maintain in proper working order to thereby provide appeal to modem archers who shoot as a form of recreation and therefore have an aversion to highly unreliable or complex bow technologies.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| Storer | 3,595,213 | July 27, 1971 |
| Nishioka | 3,744,473 | July 10, 1973 |
| Ketchum | 3,990,425 | November 9, 1976 |
| Groves, et al. | 3,993,039 | November 23, 1976 |
| Jones | 4,227,509 | October 14, 1980 |
| Islas | 4,287,867 | September 8, 1981 |
| Simonds, et al. | 4,368,718 | January 18, 1983 |
| Simonds | 4,438,753 | March 27, 1984 |
| Hayes | 4,478,203 | October 23, 1984 |
| Jennings | 4,561,413 | December 31, 1985 |
| Kudlacek | 4,593,674 | June 10, 1986 |
| Imes | 4,646,708 | March 3, 1987 |
| Humphrey | 4,667,649 | May 26, 1987 |
| Chattin | 4,724,820 | February 16, 1988 |
| Lester | 4,781,168 | November 1, 1988 |
| Bozek | 4,858,588 | August 22, 1989 |
| Colley, et al. | 4,903,677 | February 27, 1990 |

Islas teaches the use of a complex cam driven compound bow.

Lester is another example of a complicated bow structure.

The other prior art listed above, but not specifically discussed, teach other devices for recurve bows and further catalog the prior art of which the applicant is aware. These references diverge even more starkly from the references specifically distinguished above.

SUMMARY OF THE INVENTION

A recurve bow including a rigid handle having rigid upper and lower riser sections integrally formed therewith is disclosed. The handle and riser unit include respectively a top and bottom end. A top limb is pivotally connected to a top end of the riser and a bottom limb is pivotally connected to a bottom end of the riser. Each limb has a tip at an extremity remote from the handle. The tips are interconnected by means of a drawstring. Opposite ends of each limb support a tension cable. An end of each cable remote from its respective limb attaches to the other limb along the limb's intermediate section, remote from extremities thereof. These tension cables, in conjunction with the drawstring and the location of the pivot points, all work in conjunction to cause the limbs to bend while pivoting to develop a mechanical advantage throughout the draw when cocking the bow and power stroke. In drawing the bow to shoot, the force increases to a peak at approximately three quarters of the maximum draw. Further drawing of the bow causes tension to decrease by approximately thirty to forty percent (30%–40%) of its maximum. At this point, a stop device located on the handle may contact the cables extending between the limbs. At full draw, with this decreased tension, the archer can then have the ability to more easily hold the bow in a cocked position because less force is required to maintain the bow in this extreme state. It is then easier to aim and shoot the bow more accurately since less energy is being expended in holding the bow in a cocked, drawn position and the archer is more relaxed. Upon release of the bow string, the arrow is projected and the force is imparted to the arrow which is the reverse of the energy which was stored within the bow upon cocking. This energy is transferred to the arrow while the bow migrates back into a relatively unstressed, uncocked position.

OBJECTS OF THE INVENTION

Accordingly, it is a primary object of the present invention to provide a novel and useful archery recurve bow.

It is an object of the present invention to provide a device which is safe to use, extremely accurate and durable in construction.

A further object of the present invention is to provide a device as characterized above which avoids the requirement of cumbersome pulleys and cams as is required in a compound bow or other hybrid bows.

A further object of the present invention is to provide a device as characterized above which lends itself to the benefits of mass manufacturing techniques.

A further object of the present invention is to provide a device as characterized above in which the bow is formed from a minimum number of components: a handle having an upper and lower riser portion which supports an upper and lower limb in pivotal relationship. A drawstring connects tips of the limbs. Each limb is connected to the other limb by means of two cables. The force on each limb can be equalized via the cables.

Viewed from a first vantage point, it is an object of the present invention to provide a recurve bow which includes a handle having an upper and lower portion, an upper limb and a lower limb, each said limb having a tip at one extremity of said limb and a butt end removed from said tip, said upper limb connected to said upper portion of said handle, said lower limb connected to said lower portion of said handle, a drawstring connecting said tips of said upper and lower limbs and a first and second cable, said first cable extending from said upper limb to said lower limb, and said second cable extending from said lower limb to said upper limb.

Viewed from a second vantage point, it is an object of the present invention to provide a method for fabricating a recurve bow, the steps including pivoting an upper limb to an upper portion of a handle, pivoting a lower limb to a lower portion of the handle, attaching a first cable from the upper limb to a butt end of the lower limb, crossing the first cable with a second cable and attaching the second cable from the lower limb to a butt end of the upper limb, and attaching a drawstring between the limbs at tips of the limbs remote from the butt ends.

Viewed from a third vantage point, it is an object of the present invention to provide a recurve bow, comprising in combination a handle having a hand grip area and an arrow rest shelf above said hand grip area and located on one side of said handle, an upper limb and a lower limb connected to said handle at a respective upper and lower handle end, a drawstring connecting tips of said limbs, and a first cable and a second cable connecting said limbs, said first and second cables crossing each other at said handle on a side remote from said arrow rest.

These and other objects will be made manifest when considering the following detailed specification when taken in conjunction with the appended drawing figures.

DESCRIPTION OF PREFERRED EMBODIMENTS

Figures 1, 2, 2A, 3:
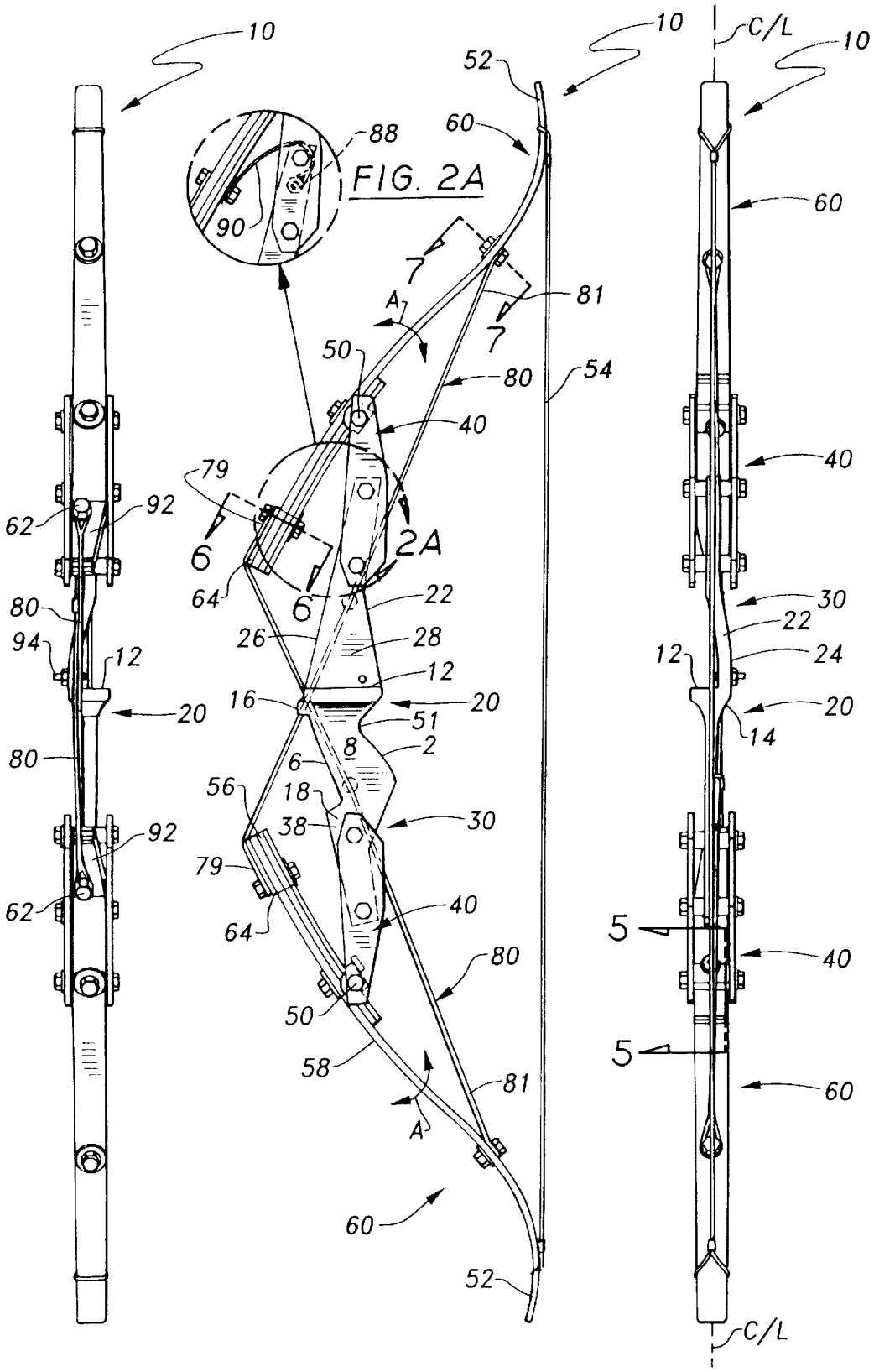
FIG. 1 is a front view of the apparatus according to the present invention.
FIG. 2 is a side view of that which is shown in FIG. 1.
FIG. 2A is a detail of a portion of FIG. 2, showing an alternative embodiment.
FIG. 3 is an end view opposite from FIG. 1.

Considering the drawings, wherein like reference numerals denote like parts throughout, reference numeral 10 is directed to the recurve bow according to the present invention.

In its essence, the recurve bow 10 includes a handle 20 having an integrally formed upper and lower portion defined as an upper riser 30 and a lower riser 30, respectively. Limbs 60 are connected to the handle 20 at the riser portions 30 by means of guide plates 40 which are located at the upper riser and lower riser portions. The upper guide plates 40 sandwich the upper limb 60 and the lower guide plates 40 sandwich the lower limb 60. The limbs are pivotally connected to the guide plates. The limbs have two extremities: a tip and a butt end. Each tip is interconnected by a drawstring. The butt end of the lower limb is connected to the upper limb by means of a first cable 80. Similarly, the butt end of the upper limb is connected to the intermediate portion of the lower limb by means of a second cable 80.

More specifically, and referring to FIGS. 1 through 4, details of the handle 20 can now be explored. As shown, the handle 20 includes a hand grip area which lends itself to grasping by the hand of an archer. The hand grasping area includes a rear edge or backwall 2, a first sidewall 4, a front edge or frontwall 6 and a second sidewall 8. Located directly above the handgrip area and above sidewall 8, an arrow shelf 12 is provided. The backwall 2 is contoured to receive the portion of one's palm nearest the wrist. Since a right-handed bow is shown, sidewall 8 engages the remainder of the palm area and leads to the front wall 6 which received the portions of the fingers nearest the palm. Opposite sidewall 4 allows the free ends of the fingers to wrap thereon, with the thumb placed on the sidewall 4 as well. Note that the front wall is substantially linear but canted from a vertical plane so that the top portion of front wall 6 leads its bottom portion. In addition, note that the backwall area adapted to receive top of the palm (i.e., under the arrow shelf 12) is closer to the front wall than any other part of the back wall 2. This assures that the thumb, in conjunction with the fingers, provide a secure yet comfortable grip on the handle. The finger support area of front wall 6 is defined as an area between an upper finger stop 16 and a lower finger stop 18. A bottom surface of the arrow shelf 12 serves as a purchase area and secure abutment for a top portion of the archer's palm. On the sidewall 4, a similar offset 14 is provided to serve as a support for a top portion of one's thumb. The offset 14 also allows the upper riser 30 to support an upper limb 60 with adequate clearance and free from interference of cables 80 to be discussed which cross each other near the offset 14.

Figure 4:
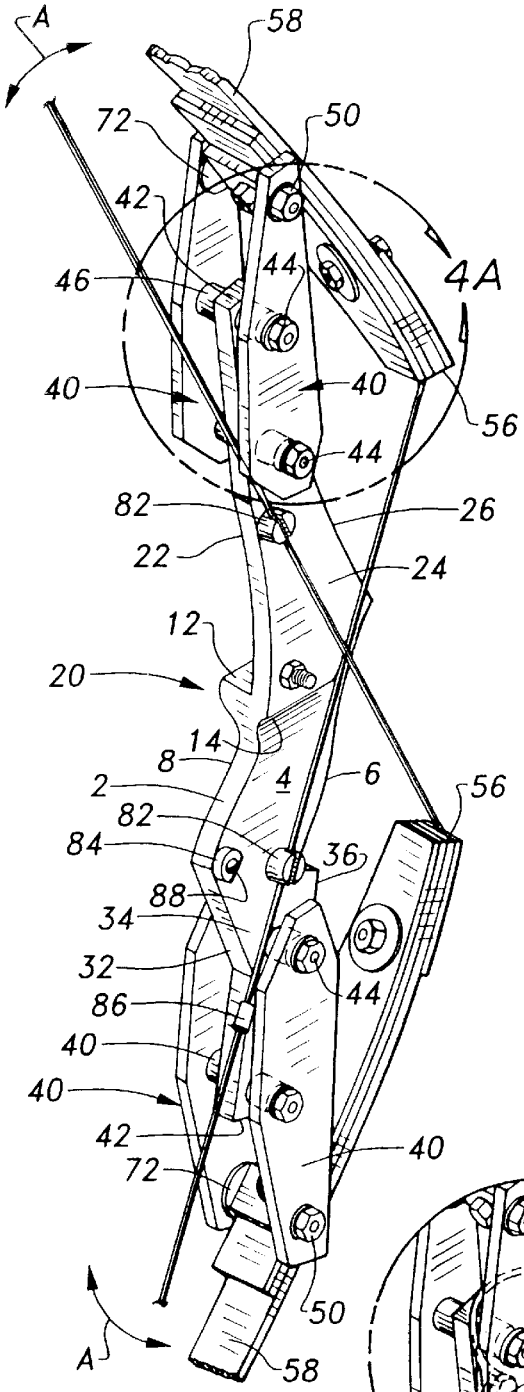
FIG. 4 is a perspective view of the apparatus according to the present invention.

More specifically, the shelf 12 and the offset 14 communicate with an upper riser 30 at an upper portion of the handle. Upper riser 30 has a back wall 22, one sidewall 24, a front wall 26 and an opposite sidewall 28. As shown in FIG. 3, the sidewalls 24 and 28 are curved where the arrow shelf 12 is located and then the sidewalls 24, 28 curve back to a geometrical center line C/L and terminate at an upper extremity. From FIG. 2, it can be seen that the upper riser 30 both tapers as it extends away from a handgrip area and sweeps rearwardly, towards drawstring 54. The walls 22, 24, 26, 28 of the riser neck down to a free end 42 (FIG. 4).

Similarly, the handle 20 includes a lower riser 30 having a back wall 32, a sidewall 34 a front wall 36, and another sidewall 38 held in spaced relationship from sidewall 34. The lower riser 30 tapers inwardly and downwardly away from the handgrip and similarly terminates in an end wall 42.

Adjacent endwalls 42, the tapered free ends of the upper and lower risers 30 support guide plates 40. A lower pair and upper pair of guide plates 40 are fixed to the lower and upper risers 30 respectively. Bolts 44 extend between the guide plates 40 and free ends of the risers 30. Two bolts 44 between each pair of the guide plates 40 and riser 30 assure that there shall be negligible motion between the guide plates and the riser. The guide plates 40 are held spaced from the handle's risers 30 by means of spacers 46 interposed between the riser 30 and each plate 40 and supported by bolts 44. The spacers 46 hold the guide plates 40 a distance apart sufficient to allow free ends of the guide plates to receive limbs 60.

The upper limb 60 is pivotally connected to the upper pair of guide plates 40 via pivot 50. The lower limb 60 is also pivotally connected to the lower pair of guide plates 40 via pivot 50 so that the limbs 60 can move about the direction of the double ended arrow A shown in FIG. 2 and 4. Note that the upper and lower pivot 50 is generally in vertical alignment with a crotch area 51 defined as the area between the thumb and the index finger of the archer which grasps the handle. In this way, the major load-bearing areas of the bow are supported at an area of greatest strength of the archer. Notice also that the lowest bolts 44 are also in line with the two pivot points 50 and with the crotch area 51 on the handle. The upper bolts nearest the upper end of the riser are slightly away from the pivot 50 toward the drawstring 54 so that the center of gravity of the bow is moved along the length of the arm of the archer for greater control and stability.

Figure 5:
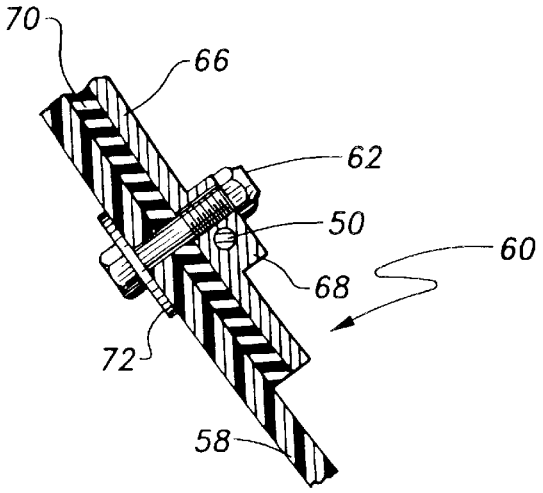
FIG. 5 is a sectional view taken along lines 5—5 of FIG. 3.
Figure 9:
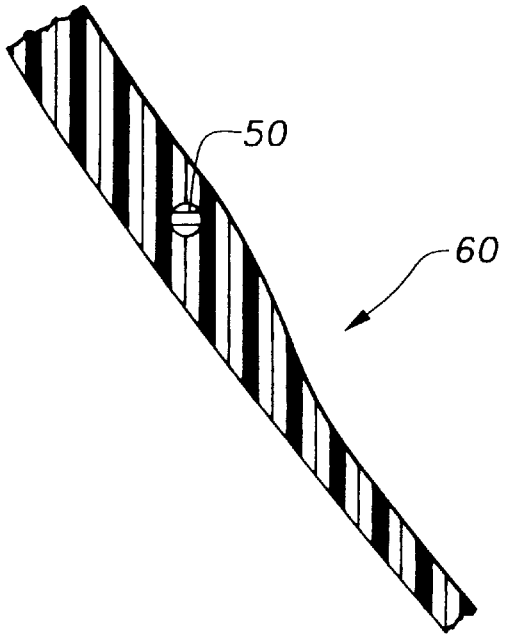
FIG. 9 is alternative to that which is shown in FIG. 5.

As shown in FIGS. 2 and 4, upper and lower limbs 60 are pivotally attached to the guide plates 40 via pivot 50. Since symmetry exists with respect to the upper and lower limbs 60, they will be discussed at the same time. FIGS. 5 and 9 show two forms of limb at an area of connection with the pivot 50. As suggested in FIG. 9, the limb 60 can be formed as a monolith comprised of an integrally cast structure or a plurality of synthetic materials such as boron, fiberglass, Kevlar® or graphite, with layers of impregnated resin holding adjacent layers together and then bonded through heat and pressure to provide a unitary mass. FIG. 5 shows a laminated limb where the individual lamina can also be formed from synthetic materials as described from FIG. 9 or can be formed from strips of wood and then bonded together with adhesive.

Each limb has a tip 52 to which a drawstring 54 is attached. Since the bow is a recurve bow, notice that the tip 52 of each limb 60 curves so that, when contacted by the drawstring 54, the drawstring 54 touches the tip 52 substantially tangentially and a terminal end of the tip 52 curves away from the drawstring 54 and towards the front of the bow. The limb nearest the tip 52 is thinnest. As the limb 60 extends from the drawstring 54, towards the pivot 50 and then toward its distal extremity remote from the tip 52 (i.e., its butt end 56) it increases in thickness.

Figure 6:
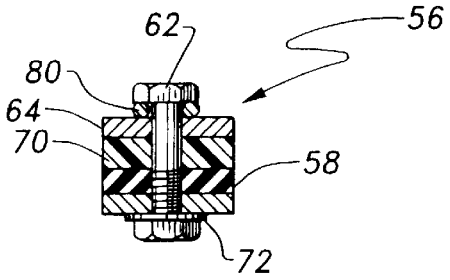
FIG. 6 is a sectional view taken along lines 6—6 of FIG. 2.

As shown in the bottom of FIG. 2, for example, one strata 58 of the limb extends from the tip 52 to the butt end 56. The butt end 56 has the area of major reinforcement. As shown in FIG. 6, the butt end 56 utilizes a connecting pin 62 such as a bolt and nut combination to secure one eyelet end of the cable 80. A force distribution plate 64 is located nearest the cable 80 and sandwiches the cable eyelet with the bolt 62. The distribution plate 64 preferably only extends a short distance along the limb 60. However, as shown in FIG. 5, a force distribution platen 66 extends from the butt end 56 beyond the area where the limb 60 connects to the guide plates via pivot 50. Note in FIG. 5 that the platen 66 includes a raised portion 68 adjacent the pivot 50 to provide a purchase area for the pivot 50 to pass therethrough. The platen 66 also supports another bolt 62 adjacent the pivot 50 and includes a force distribution washer 72 on an opposite side from the pivot. Coextensive with platen 66 is a resilient member 70 that runs from the pivot area back to the butt end. Collectively, the laminate that extends between the butt area and the pivot 50 tends to provide support for loads imposed thereon so that the flexing of the limb occurs primarily between the tip 52 and the pivot 50 of the limb 60 rather than between the butt end 56 and the pivot 50. Note that the pivot 50 is located about one third of the distance along the length of the limb 60 measured from the butt end 56.

Figure 7:
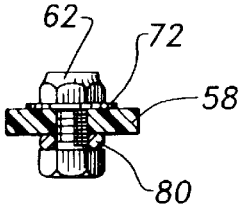
FIG. 7 is a sectional view taken along lines 7—7 of FIG. 2.

As mentioned, upper and lower cables 80 are placed on the bow such that one end 79 of the cable 80 is adjacent the butt end 56 of one limb 60 and another end of the cable is attached to the other limb nearer the tip. More specifically, the other end 81 of cable 80 is attached to the limb between the pivot 50 and tip 52 as shown in FIG. 7. An eyelet or loop of cable 80 passes around the bolt 62 on one side of the strata 58. An opposite side distributes force by means of a washer 72. Note that the connection of the cable 80 as shown in FIG. 7 occurs substantially one third of the way from the tip or two thirds of the way from the butt end 56 or halfway between the pivot 50 and tip 52.

The cable 80 then passes down and connects to the force distribution plate 64 on the other limb. For example, looking at FIG. 2, the upper limb 60 shows the cable 80 extends from a portion of the limb nearest the tip 52 and then passes over the handle near upper finger stop 16 on its way to the butt end 56 of lower limb 60 and force distribution plate 64 where it is looped onto the bolt 62 shown in FIG. 6. Similarly, the lower cable 80 extends from butt end 56 of the upper limb 60 at the upper limb's force distribution plate 64 and passes over the handle near the upper finger stop 16 before connecting to the lower limb 60 one third of the way from the limb tip 52. Notice that one cable crosses on a side of the handle adjacent side wall 24 and passes forward of the archer's hand. Notice the other cable crosses the side of the handle 20 at side wall 4 and passes between the archer's thumb and finger tips, allowing the cable sufficient clearance from the archer's hand.

Figure 4A:
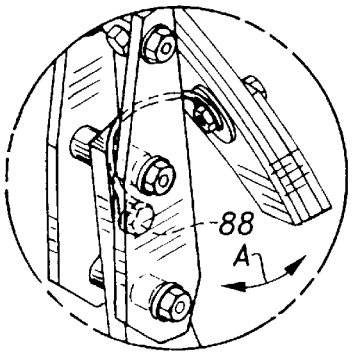
FIG. 4A shows the alternative embodiment reflected in FIG. 2A, also in perspective.

In FIG. 4, details of the range of motion of the cables 80 can be explored. Each cable 80 is held from the sidewall 4 by means of a cable slide 82. The lower cable (i.e., that which extends from the upper limb butt to the lower limb) has its slide 82 located on the sidewall 4. The other cable 80 has its slide 82 located on the sidewall 24 of the upper riser 30. These slides 82 are attached to the cables and move along the risers 30 shown in FIG. 4. The lower cable includes a stop 86 which is oriented to coact with an "overdraw" cable stop 84 located on the handle at the sidewall 4 nearest the back wall 32 at its confluence with back wall 2 of the handle 20. The cable stop 84 is fastened to the handle by means of a screw, is generally cylindrical and includes a flattened side 88 to abut against the cable stop 86 contained on the lower cable. The cable stops 84, 86 limit the degree to which the bow can be flexed to prevent the bow from being overextended ("overdrawn"). Another technique for achieving this is shown in FIGS. 2A and 4A.

A tether pin 88 is placed on one of the risers 30 at either the upper extremity or the lower extremity. The tether pin connects to the tether 90 which communicates with the butt end 56 of either limb by means of the tether 90 and its connection to the bolt 62 nearest the butt end. As the limb moves about the arc of the double ended arrow A, the limit to which the limb can move is determined by the length of the tether 90.

In addition to the foregoing, certain nuances can now best be appreciated. For example, notice how the butt end 56 of the limb has a taper 92 (FIG. 1) as the limb 60 terminates at the butt end 56. The intent of this taper is to encourage the bolt 62, which forms the fastening and is also preferably offset, to provide clearance so that the cables 80 are free from interfering with the archer's hand grip 20 and also reduces friction where the cables come in contact with the handle and also allows clearance for the arrow. Thus, the taper and bolt are on the same side as offset 14 of the handle. Also notice in FIGS. 1 and 3, for example, the existence of an arrow site 94 which passes through the sidewalls 24 and 28 of the upper riser. This site 94 assists in the archer accurately placing the arrow prior to shooting the arrow especially when the arrow is resting on the arrow shelf 12.

Figure 8:
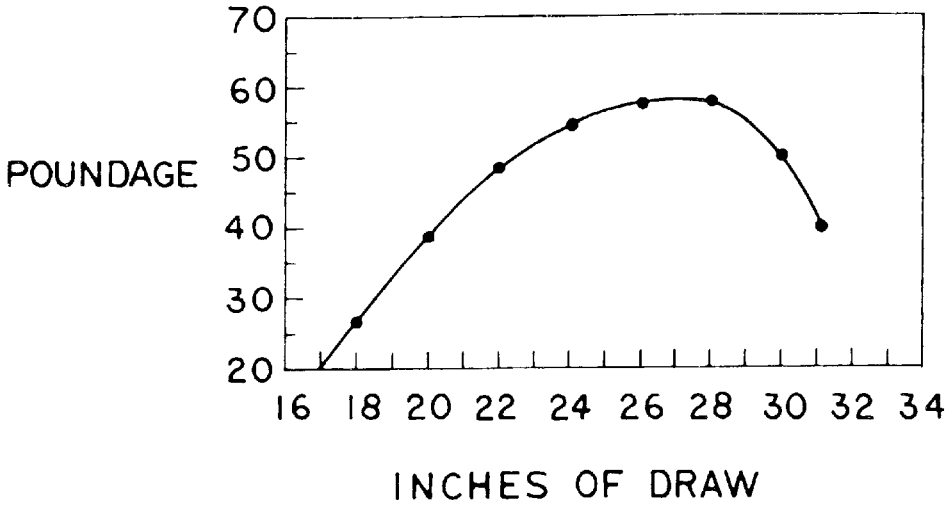
FIG. 8 is a graph showing the force profile, in pounds as a function of inches of draw for the recurve bow.

In use and operation, an arrow is placed on the shelf 12 and the notched end is advanced into the drawstring 54. By pulling the drawstring back, the limbs move in the direction of the double ended arrow A and the force required to keep the bow in its fully cocked position is shown in FIG. 8. Whereas most bows do not have a force diagram where the force required tapers off and actually decreases after three quarter draw, the bow according to the instant invention does so thereby allowing the archer to keep the bow held in a cocked position relatively comfortably to allow for more precise siting and targeting. By having the cables 80 connect from one limb to the other, the force generated by each limb is uniform and therefore any manufacturing anomalies with respect to different limbs can be adjusted by the interconnecting cables 80.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A recurve bow, comprising in combination:

a handle having an upper and lower portion and a front and a rear;

a flexible upper limb and a flexible lower limb, each said limb having a tip at one extremity of said limb and a butt end remote from said tip;

said upper limb pivotally connected to said upper portion of said handle, said lower limb pivotally connected to said lower portion of said handle;

a drawstring connecting said tips of said upper and lower limbs adjacent the rear of the handle; and a first cable and a second cable, said first cable connected and routed directly from said upper limb to said lower limb and said second cable connected and routed directly from said lower limb to said upper limb, said first and second cables crossing each other at the front of the handle and opposite the drawstring, said upper limb and lower limb store energy as the drawstring is connected and as the bow is drawn.

2. The bow of claim 1 wherein a pair of guide plates are disposed at said upper and lower portions of said handle, each said guide plate pair supporting a limb.

3. The bow of claim 2 wherein said handle's upper and lower said portions are formed as risers, said upper riser separated from said handle by means of an arrow shelf and an offset.

4. The bow of claim 3 wherein said butt end of each said limb supports one end of a said cable, and another end of said cable is connected and routed directly to said other limb near said tip of said other limb.

5. The bow of claim 4 wherein each said limb is connected to said riser via a pivot.

6. The bow of claim 5 wherein each said pivot extends through said guide plate.

7. The bow of claim 6 wherein said pivot of each said limb is in a line with a portion of the handle.

8. A method for fabricating a recurve bow, the steps including:

pivoting a flexible upper limb to an upper portion of a handle;

pivoting a flexible lower limb to a lower portion of the handle;

attaching a first cable directly from the upper limb to a butt end of the lower limb;

crossing the first cable with a second cable such that the cables cross at a front side of the handle, and attaching the second cable from the lower limb directly to a butt end of the upper limb; and attaching a drawstring between the limbs at tips of the limbs remote from the butt ends such that the drawstring is on a rear side of the handle opposite the front side where the cables cross.

9. The method of claim 8 including placing the pivot of each limb onto the handle such that one third of each limb extends from the butt area to the pivot.

10. The method of claim 9 including placing the connection of one cable from one limb to the other limb such that it extends halfway between the pivot and the tip of the limb.

11. The method of claim 10 including sandwiching each limb between guide plates and fastening the guide plates to the handle.

12. The method of claim 11 including crossing the first and second cables forward of the handle on a side of the handle remote from an arrow rest.

13. The method of claim 12 including offsetting the handle where the cables cross so that there is clearance for the hand of an archer.

14. The method of claim 13 including limiting the degree to which the limbs can move with respect to the handle.

15. The method of claim 14 including providing a tether to limit travel.

16. The method of claim 14 including providing a stop to limit travel.

17. A recurve bow, comprising in combination:

a handle having a hand grip area and an arrow rest shelf located on one side of said handle and above said hand grip area;

a flexible upper limb and a flexible lower limb connected to said handle at a respective upper and lower handle end;

a drawstring connecting tips of said limbs rearward of said handle; and a first cable and a second cable connecting said limbs, said first and second cables crossing each other forward of said handle and on a side remote from said arrow rest shelf.

18. The bow of claim 17 including a riser section interposed between each said upper and lower limb and integrally formed with said handle, said risers forming supports for guide plates thereon, said guide plates including pivots and sandwiching each said limb and allowing pivotal motion thereabout, said pivots on said guide plates at said limb falling in line with said hand grip area.

19. The bow of claim 18 wherein said first and second cables cross forward of said handgrip area and said drawstring is rearward of said handgrip area when said bow is uncocked.

20. The bow of claim 19 wherein said handgrip area is offset from said cable to allow grasping by an archer.

21. A recurve bow, comprising in combination:

a handle having a hand grip area and an arrow rest shelf above said hand grip area and located on one side of said handle;

a flexible upper limb and a flexible lower limb connected to said handle at a respective upper and lower handle end;

a drawstring connecting tips of said limbs;

a first cable and a second cable connecting said limbs, said first and second cables crossing each other at said handle on a side remote from said arrow rest; and a riser section interposed between each said upper and lower limb and integrally formed with said handle, said risers forming supports for guide plates thereon, said guide plates including pivots and sandwiching each said limb and allowing pivotal motion thereabout, said pivots on said guide plates at said limb falling in line with a crotch area of holder's hand at the juncture with the thumb and index finger of the archer.

22. A recurve bow, comprising in combination:

a handle having a hand grip area and an arrow rest shelf above said hand grip area and located on one side of said handle;

a flexible upper limb and a flexible lower limb, each having a pivotal connection to said handle at a respective upper and lower handle end;

a drawstring connecting tips of said limbs rearward of each said pivotal connection; and a first cable and a second cable connecting said limbs, said first and second cables crossing each other on a side remote from said arrow rest;

wherein said first and second cables cross forward of each said pivotal connection when said bow is uncocked.

23. A recurve bow, comprising in combination:

a handle having a hand grip area and an arrow rest shelf above said hand grip area and located on one side of said handle;

a flexible upper limb and a flexible lower limb connected to said handle at a respective upper and lower handle end;

a drawstring connecting tips of said limbs; and a first cable and a second cable connecting said limbs, said first and second cables crossing each other forward of said handle on a side remote from said arrow rest;

wherein said first and second cables cross forward of said handgrip area and said drawstring is rearward of said handgrip area when said bow is uncocked.

24. A method for fabricating a recurve bow, the steps including:

pivoting a flexible upper limb to an upper portion of a substantially non-flexible handle;

pivoting a flexible lower limb to a lower portion of the handle;

attaching a first cable from the upper limb directly to a butt end of the lower limb;

crossing the first cable with a second cable such that the cables cross on one side of the handle, and attaching the second cable from the lower limb directly to a butt end of the upper limb; and attaching a drawstring between the limbs at tips of the limbs remote from the butt ends;

vertically aligning the limbs where they pivot with a crotch area of a holder's hand at the juncture of a thumb and index finger of an archer.

25. A recurve bow, comprising in combination:

a handle having a hand grip area;

a flexible upper limb and a flexible lower limb connected to said handle at a respective upper and lower handle end;

a drawstring connecting tips of said limbs rearward of said handle; and a first cable and a second cable connecting said limbs, said first and second cables crossing each other forward of said handle.

26. A recurve bow, comprising in combination:

a handle having a hand grip area located between upper and lower handle ends;

a flexible upper limb and a flexible lower limb, said limbs having tips and butt ends, said limbs connected near said butt ends to said handle at a respective upper and lower handle end;

a drawstring connecting said tips of said limbs; and a first cable and a second cable connecting said limbs, said first and second cables crossing each other forward of said handle on a side remote from said drawstring.

27. In combination, a bow having a handle and a hand grip area;

an upper flexible limb and a lower flexible limb connected to the handle at handle ends;

a drawstring rearward of the handle connecting the limbs; and two tension cables, one cable crossing from the upper limb to the lower limb and the other cable crossing from the lower limb to the upper limb, said cables crossing each other at the handle at the grip forward of the crotch area of the holder's hand at the juncture where the thumb and index finger meet.

* * * * *

UNITED STATES PATENT AND TRADEMARK OFFICE

CERTIFICATE OF CORRECTION

PATENT NO. : 5,934,264
DATED : August 10, 1999
INVENTOR(S) : Doornenbal, J.

It is certified that error appears in the above-identified patent and that said Letters Patent is hereby corrected as shown below:

Column 1,
Line 52, kindly change "modem" to -- modern --.
Line 56, kindly change "modem" to -- modern --.

Signed and Sealed this

Seventh Day of May, 2002

*Attest:*

*Attesting Officer*

JAMES E. ROGAN
*Director of the United States Patent and Trademark Office*